United States Patent [19]

Sarich

[11] 3,938,916

[45] Feb. 17, 1976

[54] GAS SEAL FOR VANE TYPE INTERNAL COMBUSTION ENGINE

[76] Inventor: Tony Ralph Sarich, 2 Hadley Place, Karrinyup, Western Australia, Australia

[22] Filed: Jan. 16, 1974

[21] Appl. No.: 433,747

[30] Foreign Application Priority Data

Jan. 16, 1973 Australia ..... 1916/73

[52] U.S. Cl. ..... 418/137; 418/139; 418/145

[51] Int. Cl.[2] F01C 19/00; F03C 3/00; F04C 15/00; F04C 27/00

[58] Field of Search ..... 418/136, 137, 145–148, 418/61 R, 257, 139

[56] References Cited

UNITED STATES PATENTS

| | | | |
|---|---|---|---|
| 910,175 | 1/1909 | Cole | 418/61 R |
| 3,269,329 | 8/1966 | Eickmann | 418/136 |
| 3,809,024 | 5/1974 | Abbey | 418/139 |

*Primary Examiner*—John J. Vrablik

[57] ABSTRACT

A vane type engine having a housing, a shaft journalled therein with a piston member mounted on the shaft and a plurality of vanes forming with the housing a piston member a plurality of chambers. A seal member supported in each opposite axial end face of the piston member and engaging the end walls of the housing, an insert supported in each vane and extending therethrough to engage at one end the seal member in the piston member and at the other end the base of the slot in which the vane is disposed, the fit between the insert and the vane extension being such as to prevent the passage of gas between the insert and the vane extension but to permit movement therebetween in the axial direction resulting from different expansion of the piston, vane and housing during operation.

8 Claims, 4 Drawing Figures

GAS SEAL FOR VANE TYPE INTERNAL COMBUSTION ENGINE

This invention relates to an improved seal for incorporation in a vane type internal combustion engine between the vane and another component.

Because the vane is exposed to severe temperature conditions in the engine, the expansion thereof under normal operating conditions is greater than the other component. At some locations, this expansion tends to move the vane away from a related component and the resultant increased clearance provided a path for the escape of gas from the combustion chamber. Even though a seal may be provided between the vane and the related component in this area, the increase in the clearance due to expansion of the vane will naturally reduce the contact pressure between the seal and the respective components with a resultant reduction in seal efficiency.

It is, therefore, the principal object of this invention to provide a seal construction between the vane and an associated component in a vane type engine which will not be adversely affected by the difference in expansion rates of the vane and the associated components.

With this object in view, there is provided an internal combustion engine having a housing, a shaft mounted for rotation relative to the housing, a piston member carried by the shaft, a plurality of vanes arranged to form with the housing and piston member a plurality of chambers which vary in capacity in response to relative rotation between the shaft and the housing, each said vane having a portion interposed between a face of the housing and a face of the piston member, a seal interposed between one of said faces and the portion of the vane, an insert supported in said portion of the vane and extending therethrough in a direction normal to said faces and in engagement with the seal and the other of said face, the fit between the insert and said portion of the vane carrying it being such as to prevent the escape of gas from the chamber between the insert and the vane portion but to permit movement therebetween in a direction normal to the faces resulting from different expansion of the piston, vane and housing during operation.

Conveniently, said faces of the piston and housing are radially disposed with respect to the axis of the shaft and the portion of the vane interposed therebetween and supporting the insert is in the form of a leg extending radially with respect to the shaft. Preferably, the portion of the vane is disposed within a slot in the end wall of the housing and the insert is provided with a head portion at said one end which engages the seal and the opposed side walls of the slot.

In one arrangement, the engine comprising a housing having a generally cylindrical cavity defined by a peripheral wall and opposed end walls, a shaft rotatably supported in the housing coaxial with the cavity, a piston member disposed within the cavity and journalled eccentrically on said shaft to describe an orbital path about the shaft axis when the shaft rotates, a plurality of vanes disposed radially to and spaced equally about the shaft axis, each vane being slidably supported at each axial end in respective radial slots in the end walls for reciprocal movement radially with respect to the shaft axis, a radial extension on each axial end of each vane disposed within the respective slots, said extension being connected to the piston member so that each vane may reciprocate relative to the piston member in a direction at right angles to the direction of reciprocation of the vane in the housing upon orbiting of the piston member, sealing means operatively disposed between each vane and the piston member, the housing peripheral wall and the housing end walls to divide the cavity into a plurality of chambers, the volume of each chamber varying as the piston member orbits, said sealing means including a seal member supported in each opposite axial end face of the piston member and engaging the end walls of the housing, an insert supported in each vane extension and extending therethrough to engage at one end the seal member in the piston member and at the other end the base of the slot in which the extension is disposed, the fit between the insert and the vane extension being such as to prevent the passage of gas between the insert and the vane extension but to permit movement therebetween in the axial direction resulting from different expansion of the piston, vane and housing during operation.

By the provision of an insert which extends through the portion of the vane, but is free to move relative thereto, if the vane expands at a greater rate than the piston member or the housing, the resultant movement of the portion of the vane interposed between these two components does not affect the sealing therebetween, as the movement of the vane does not cause any corresponding movement of the insert which in effect is establishing the seal at that point.

In one practical arrangement, the insert is in the form of a pin extending through an aperture in the projecting portion of the vane and having an enlarged head at each end. The clearance between the pin and the hole in the leg in which it is received is such that sliding movements may take place therebetween in the direction of the axis of the pin. It will, of course, be appreciated that, in practice, the extent of movement only amounts to several thousandths of an inch.

The head portions at each end of the pin are received in recesses extending across the full width of the portion of the vane, and the respective head portions also extend across the full width of the vane. The overall length of the pin across the head is selected so that when the vane with the pin in position is assembled between the end wall and the piston of the engine with one head engaging the end wall the correct clearance will exist between the other head and the piston for efficient operation of the seal carried by the piston which engages said other head. Accordingly, any expansion of the vane in the axial direction due to heating of that portion of the vane exposed to extreme temperature conditions will not cause any relative movement between the pin and the end face and piston, and so the correct clearance will be maintained for effective operation of the seal independent of the vane expansion.

The invention will be more readily understood from the following description of one practical arrangement of an orbital engine incorporating the invention, and as illustrated in the accompanying drawings. In the drawings.

Figure 1:
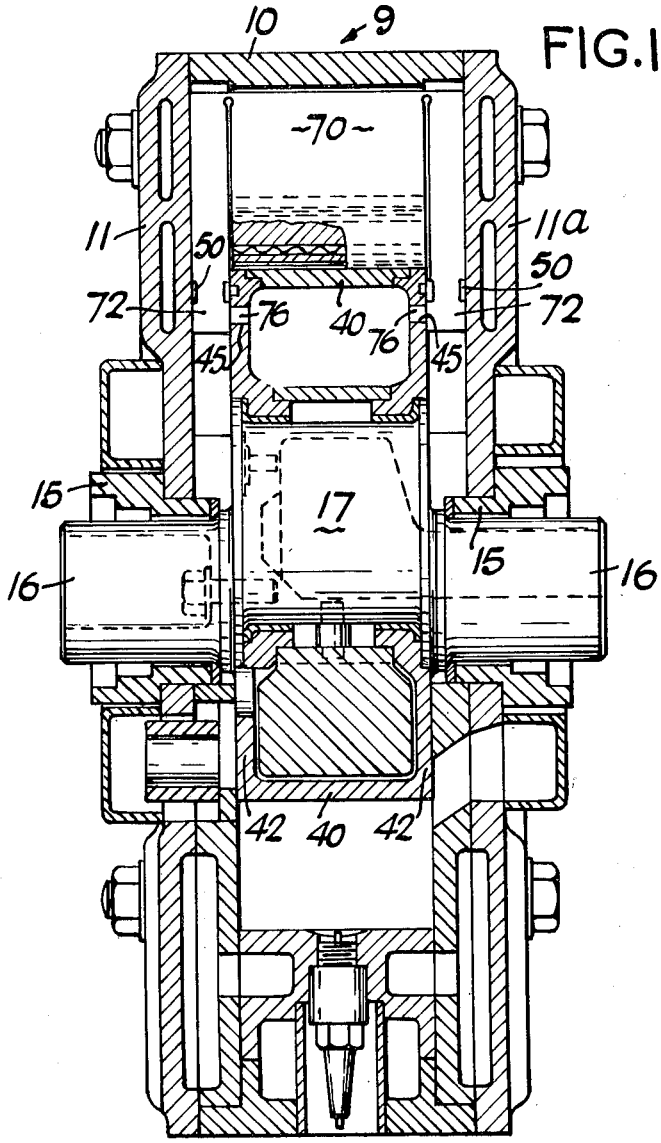
FIG. 1 is a section elevation of the engine along a diametral plane.
Figure 2:
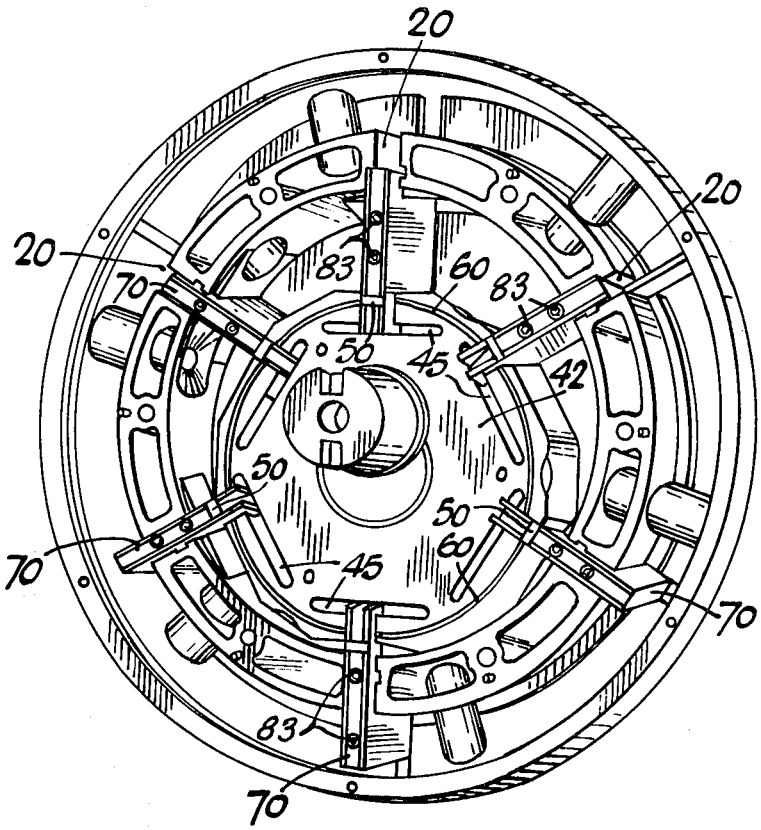
FIG. 2 is a perspective side elevation with one end plate removed to show the vanes and piston.

Referring now to the drawing, the engine generally comprises a housing 9 formed by the annular portion 10 and opposed end plates 11, 11*a*, the crankshaft 16 supported in bearing 15 mounted in the end plates, and the piston 40 mounted on the journal 17 of the crankshaft 16.

The vanes 70 are supported in the housing for sliding movement in a radial direction with respect to the crankshaft 16. Each vane 70 includes at each axial end thereof a leg 72 attached thereto by studs 83, and the legs 72 are slidably received in radial slots 71 formed in the respective end plates 11, 11*a*. The vanes are also supported in slots 20 in the annular portion 10 of the housing.

In each side face 42 of the piston member there are provided six equally spaced slots 45 arranged in the formation of a hexagon having an axis coincident with the axis of the journal 17 of the crankshaft. The laterally projecting pin 76 secured to the inner end of each vane leg 72 extends into the respective slots 45 so that, as the piston member orbits in the housing, the vanes reciprocate radially in the housing and slide relative to the piston member in a direction normal to the plane of the vane.

The seal means 73 are located in a recess in the radially inner end of each vane to engage the peripheral surface 46 of the piston member 40. Seal strips 74 on each side of each leg 72 of each vane engage the opposite side walls of the slot 71 in the end plate which supports the vane. Seal rings 60 are located in grooves in the side faces 42 of the piston and engage the inner face of each end plate 11, 11*a*.

Further details of the general construction and manner of operation of this engine are found in the complete specification of Australian Patent Application No. 30650/71 or its equivalent.

The construction of the vane leg and piston in the area of the connection therebetween and the sealing arrangement in that area will now be described in more detail with reference to FIGS. 3 and 4.

The leg 72 is of generally channel shape with internal bosses 80 and 81 to support the pin 76 and stud 83 respectively. The insert 50 has an integral head 51 at the piston side of the vane leg 72 and an attached head 52 at the opposite end. The attached head 52 is an interference fitted onto a stepped down portion of the shank 50*a* of the insert to facilitate assembly, but once fitted, is effectively integral with the shank. Each head is of generally rectangular shape.

The overall length of the insert across the end faces of the heads is selected so that, in operation, the required clearance will exist between the insert and the seal member 73 carried by the piston member and the base 71*a* of the slot 71, to permit radial movement of the vane in the slot and "tangential" movement of the vane relative to the piston member. The heads 51 and 52 of the insert are received in transverse recesses in the respective faces of the vane which extend across the full extent of said faces. The opposite side faces 55 and 56 of the respective heads engage the side walls of the slot 71 in which the vane slides.

The integral head 51 and the portion of the shank 50*a* adjacent thereto is split in the direction of the extent of the slot 71, that is radially, by the narrow slit 57 which terminates at the aperture 58. The provision of the slit imparts to the head 51 a degree of resilience to enable an effective sealing contact to be obtained between the faces 55 of the head 51 and the side walls of the slot 71. The small notch in the face 55 acts as a pocket to receive oil and thus assist lubrication.

The clearance between the shank 50*a* of the insert and the aperture in the vane leg which receives it, and between the respective heads and the recesses which receive them, so that in operation the vane leg 72 may move relative to the insert in the direction of the length of the vane, that is parallel to the axes of the shaft and piston member.

The actual extent of this clearance can be determined by skilled persons and is dependent on the size of the respective components and the extent of cooling thereof.

Figure 3:
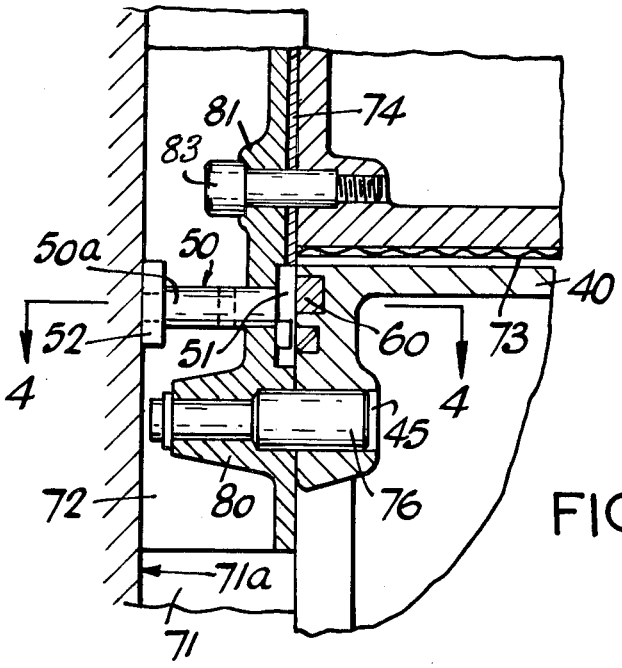
FIG. 3 is a close-up view, partially in section, showing the relationship between the insert, the piston, the vane, and the housing end wall.
Figure 4:
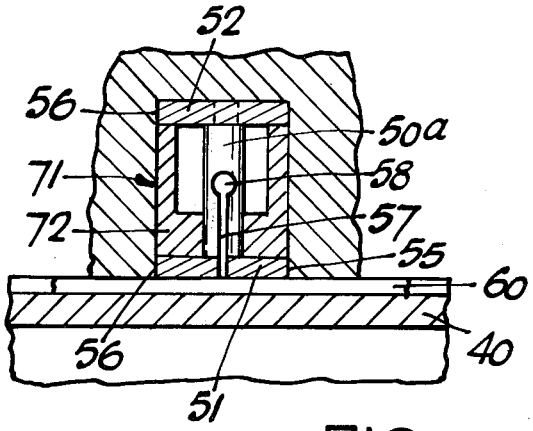
FIG. 4 is a section view along the line 4—4 in FIG. 3.

FIG. 3 only shows portion of one vane leg and the associated insert, but it will be appreciated that the leg at the opposite end of the vane is of the same construction.

I claim:

1. An internal combustion engine having a housing, a shaft mounted for rotation relative to the housing, a piston member carried by said shaft, a housing face on said housing, a piston face on said piston member in spaced opposed relationship to said housing face, a plurality of vanes arranged to form with said housing and said piston member a plurality of chambers which vary in capacity in response to relative rotation between said shaft and said housing, each said vane having a vane extension interposed between said housing face and said piston face, seal means on one of said faces adjacent to said vane extension, walls defining an opening in said vane extension at said seal means, said opening extending through said vane extension between said faces, an insert mounted in said opening and extending therethrough in a direction normal to said one of said faces, said insert being in engagement at one end with said seal means and at the other end with the other of said faces, said insert being relatively movable with respect to said vane extension in a direction normal to said one face, at least a portion of said insert having such a close fit with said walls of said opening as to be in sealing relationship therewith, whereby the passage of gas through said opening between said insert and said vane extension is prevented.

2. An engine as claimed in claim 1 wherein said faces of the piston member and housing are radially disposed with respect to axis of the shaft.

3. An internal combustion engine comprising a housing having a cavity defined by an internal housing peripheral wall and opposed housing end walls each having a housing end face, a shaft rotatably supported in said housing end walls, a piston member mounted on said shaft within said cavity, said piston member having an external piston peripheral wall in opposed relationship to said housing peripheral wall and a pair of piston side faces in opposed spaced relationship to said housing end faces, a plurality of vanes disposed in said cavity between said piston peripheral wall and said housing peripheral wall and extending to said housing end faces to divide said cavity into a plurality of chambers which vary in capacity in response to relative rotation between said shaft and said housing, each of said vanes comprising a vane extension extending beyond said piston peripheral wall and interposed between said housing end faces and said piston side faces, seal means on one of said faces adjacent to said vane extension, walls defining an opening in said vane extension at said seal means, said opening extending through said vane extension between said faces, an insert mounted in said opening and extending therethrough in a direction normal to said one of said faces, said insert being in engagement at one end with said seal means and at the other end with the other said of said faces, said insert being relatively movable with respect to said vane extension in a direction normal to said one face, at least a portion of said insert having such a close fit with said walls of said opening as to be in sealing relationship therewith, whereby the passage of gas through said opening between said insert and said vane extension is prevented.

4. An engine as claimed in claim 3 wherein the extension of the vane carrying the insert is disposed in a slot in the end face of the housing and the insert comprises a cylindrical body supported in an aperture in the vane portion and a generally rectangular head at one end of the cylindrical portion, the end face of said head engaging the seal means and two opposite side faces engaging respectively opposite sides of the slot.

5. An engine as claimed in claim 3 wherein said vane extension is disposed within a slot in the housing end face, said slot having side walls, and the insert is provided with a head portion at said one end which engages the seal means and the side walls of the slot.

6. An engine as claimed in claim 5 wherein the head portion of the insert is divided across its full width by a slit extending in a direction parallel to said slot side walls, the head portion being dimensional so as to be resiliently compressed between the side walls of the slot when located within said slot.

7. An engine as claimed in claim 6 wherein the insert comprises a body portion received in an aperture in the vane extension and having the head portion formed integral therewith, said slit in the head portion extending into the body portion.

8. An engine comprising a housing having a generally cylindrical cavity defined by a peripheral housing wall and opposed housing end walls, each of said housing end walls having an end face, a shaft rotatably supported in said housing coaxial with said cavity, a piston member disposed within said cavity and journalled eccentrically on said shaft to describe an orbital path about the axis of said shaft when said shaft rotates, said piston member having a piston peripheral wall and a pair of piston side faces in spaced opposed relationship with said housing end faces, a plurality of vanes disposed radially to and spaced equally about the axis of said shaft, each said vane spanning the distance between said housing peripheral wall and said piston peripheral wall and extending between said opposed housing end faces, each said vane being slidably supported in respective radial slots in said housing end faces for reciprocal movement radially with respect to the axis of said shaft, each said vane having a pair of radial vane extensions disposed within said slots and extending between said housing end faces and said piston side faces, each said vane extension being connected to said piston member so that each said vane in response to orbital movement of said piston member reciprocates realtive to said piston member at right angles to the direction of reciprocating movement of said vanes in said slots, first seal means disposed between each said vane and said piston peripheral wall, second seal means on said piston side faces at each said vane extension, walls defining an opening in each said vane extension at said second seal means, said opening extending through said vane extension between said faces, an insert positioned in each said opening and extending therethrough in a direction normal to said piston side faces, said insert being in engagement at one end with said second seal means and at the other end with the said slot in which said vane is mounted, said insert being relatively movable with respect to said vane extension in a direction normal to said one face, at least a portion of said insert having such a close fit with said walls of said opening as to be in sealing relationship therewith, whereby the passage of gas through said opening between said insert and said vane extension is prevented.

* * * * *